US008704645B2

(12) United States Patent
Ida et al.

(10) Patent No.: US 8,704,645 B2
(45) Date of Patent: Apr. 22, 2014

(54) REMOTE CONTROLLER AND REMOTE CONTROLLER CONTROL METHOD

(75) Inventors: Tomotaka Ida, Saitama (JP); Masahiro Muramatsu, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 254 days.

(21) Appl. No.: 13/204,365

(22) Filed: Aug. 5, 2011

(65) Prior Publication Data

US 2012/0161946 A1 Jun. 28, 2012

(30) Foreign Application Priority Data

Dec. 27, 2010 (JP) ..... 2010-290906

(51) Int. Cl.
*G08C 19/12* (2006.01)

(52) U.S. Cl.
USPC ..... 340/13.24; 341/176; 455/575.3; 345/102

(58) Field of Classification Search
USPC ..... 340/12.1, 12.22–13.36, 693.3; 398/106; 446/456; 348/734, 14.05; 345/169, 345/158; 455/41.2, 95, 99; 341/175–176
See application file for complete search history.

(56) References Cited

U.S. PATENT DOCUMENTS

| | | | | |
|---|---|---|---|---|
| 6,907,262 | B1 * | 6/2005 | Heaysman | 455/550.1 |
| 7,154,428 | B2 * | 12/2006 | de Clercq et al. | 341/175 |
| 7,911,502 | B2 * | 3/2011 | Suzuki | 348/222.1 |
| 8,350,728 | B2 * | 1/2013 | Liu et al. | 341/22 |
| 2003/0067443 | A1 * | 4/2003 | Hara et al. | 345/158 |
| 2007/0139215 | A1 | 6/2007 | Sato et al. | |
| 2009/0186663 | A1 * | 7/2009 | Griffin et al. | 455/566 |

FOREIGN PATENT DOCUMENTS

| | | |
|---|---|---|
| JP | H 02128491 | 10/1990 |
| JP | H 05128828 | 5/1993 |
| JP | H 06159779 | 6/1994 |
| JP | H 0946779 | 2/1997 |
| JP | H 1026749 | 1/1998 |
| JP | 2001128265 | 5/2001 |
| JP | 2001197178 | 7/2001 |
| JP | 2003338857 | 11/2003 |

(Continued)

OTHER PUBLICATIONS

Japanese Patent Application No. 2010-290906, Notice of Rejection, mailed Jan. 4, 2012, (with English Translation).
Japanese Patent Application No. 2010-290906, Notice of Rejection, mailed Oct. 4, 2011, (with English Translation).
Japanese Patent Application No. 2010-290906, Notice of Rejection, mailed May 15, 2012, (with English Translation).

(Continued)

*Primary Examiner* — Nabil Syed
(74) *Attorney, Agent, or Firm* — Blakely, Sokoloff, Taylor & Zafman LLP

(57) ABSTRACT

According to one embodiment, a remote controller includes first operation keys, a first illumination module, second operation keys, a second illumination module, a cover, an open-close detector, and a controller. The first illumination module illuminates the first operation keys. The second operation keys are arranged in different location than the first operation keys. The second illumination module illuminates the second operation keys. The cover is capable of covering the second operation keys. The open-close detector detects whether the cover is open or closed. The controller controls the first illumination module and the second illumination module individually to turn on or off according to whether the cover is open or closed detected by the open-close detector.

17 Claims, 8 Drawing Sheets

(56) References Cited

FOREIGN PATENT DOCUMENTS

| | | |
|---|---|---|
| JP | 2005079785 | 3/2005 |
| JP | 2005191695 | 7/2005 |
| JP | 2007-166401 | 6/2007 |
| JP | 2007166401 | 6/2007 |
| JP | 2008-289081 | 11/2008 |
| JP | 2010-187236 | 8/2010 |
| JP | 2012150774 | 8/2012 |

OTHER PUBLICATIONS

Japanese Patent Application No. 2010-290906, Decision of dismissal of amendment, mailed May 15, 2012, (with English Translation).

Japanese Patent Application No. 2010-290906, Decision of Rejection, mailed Sep. 25, 2012, (with English Translation).

Japanese Patent Application No. 2012-150774, Decision to Grant a Patent (Division), mailed Aug. 14, 2012, (with English Translation).

* cited by examiner

REMOTE CONTROLLER AND REMOTE CONTROLLER CONTROL METHOD

CROSS-REFERENCE TO RELATED APPLICATIONS

This application is based upon and claims the benefit of priority from Japanese Patent Application No. 2010-290906, filed Dec. 27, 2010, the entire contents of which are incorporated herein by reference.

FIELD

Embodiments described herein relate generally to a remote controller and a remote controller control method.

BACKGROUND

Generally, devices such as televisions, video players, digital versatile disc (DVD) players, and set-top boxes can be remotely controlled with a remote controller provided thereto. Such a remote controller has various keys or buttons to activate the functions of the device. Besides, there have been proposed technologies to improve the operability of a device such as a remote controller and a mobile phone in the dark or the like by providing a backlight (key backlight) that illuminates the keys from behind.

Operation keys on the remote controller can be classified into main keys that are mainly used and subkeys that are used for specific purposes. In the case of this key arrangement, in view of space-saving and design, subkeys are generally provided as being covered with a cover or the like and the cover is opened when they are used. The conventional remote controller is configured such that only the main keys are illuminated, or the main keys and the subkeys are illuminated at the same time. Accordingly, some keys may be unnecessarily illuminated, which may result in wasteful power consumption.

BRIEF DESCRIPTION OF THE SEVERAL VIEWS OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION

In general, according to one embodiment, a remote controller comprises first operation keys, a first illumination module, second operation keys, a second illumination module, a cover, an open-close detector, and a controller. The first illumination module is configured to illuminate the first operation keys. The second operation keys are arranged in different location than the first operation keys. The second illumination module is configured to illuminate the second operation keys. The cover is configured to be capable of covering the second operation keys. The open-close detector is configured to detect whether the cover is open or closed. The controller is configured to control the first illumination module and the second illumination module individually to turn on or off according to whether the cover is open or closed detected by the open-close detector.

Exemplary embodiments will be described in detail below with reference to the accompanying drawings. A remote controller described herein is used to remotely control a device, examples of which include a broadcast receiver such as a television, a recorder/player such as a hard disk drive (HDD) recorder, and a set-top box.

Figure 1:
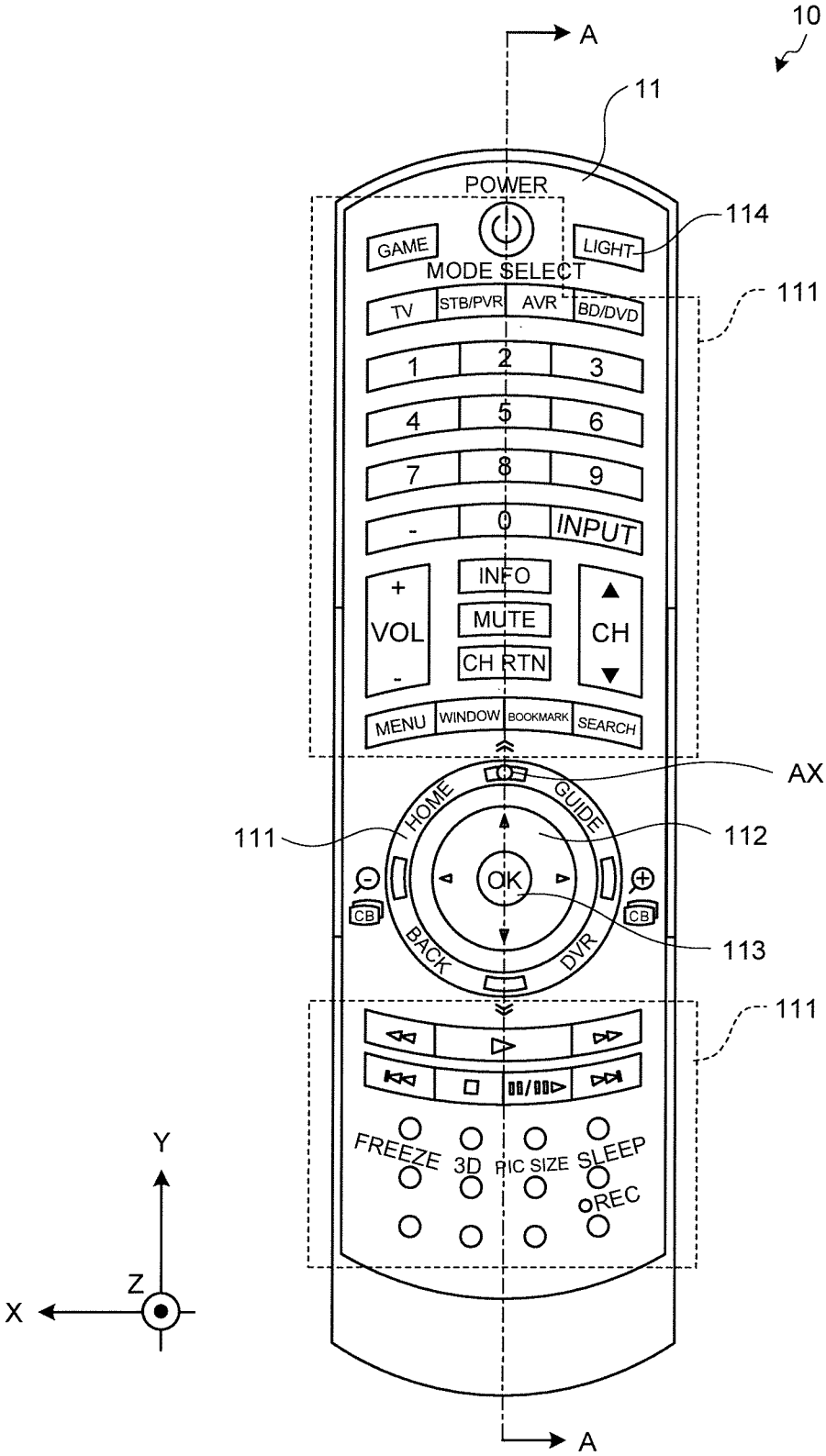
FIG. 1 is an exemplary top view of a remote controller in the closed position according to an embodiment.
Figure 2:
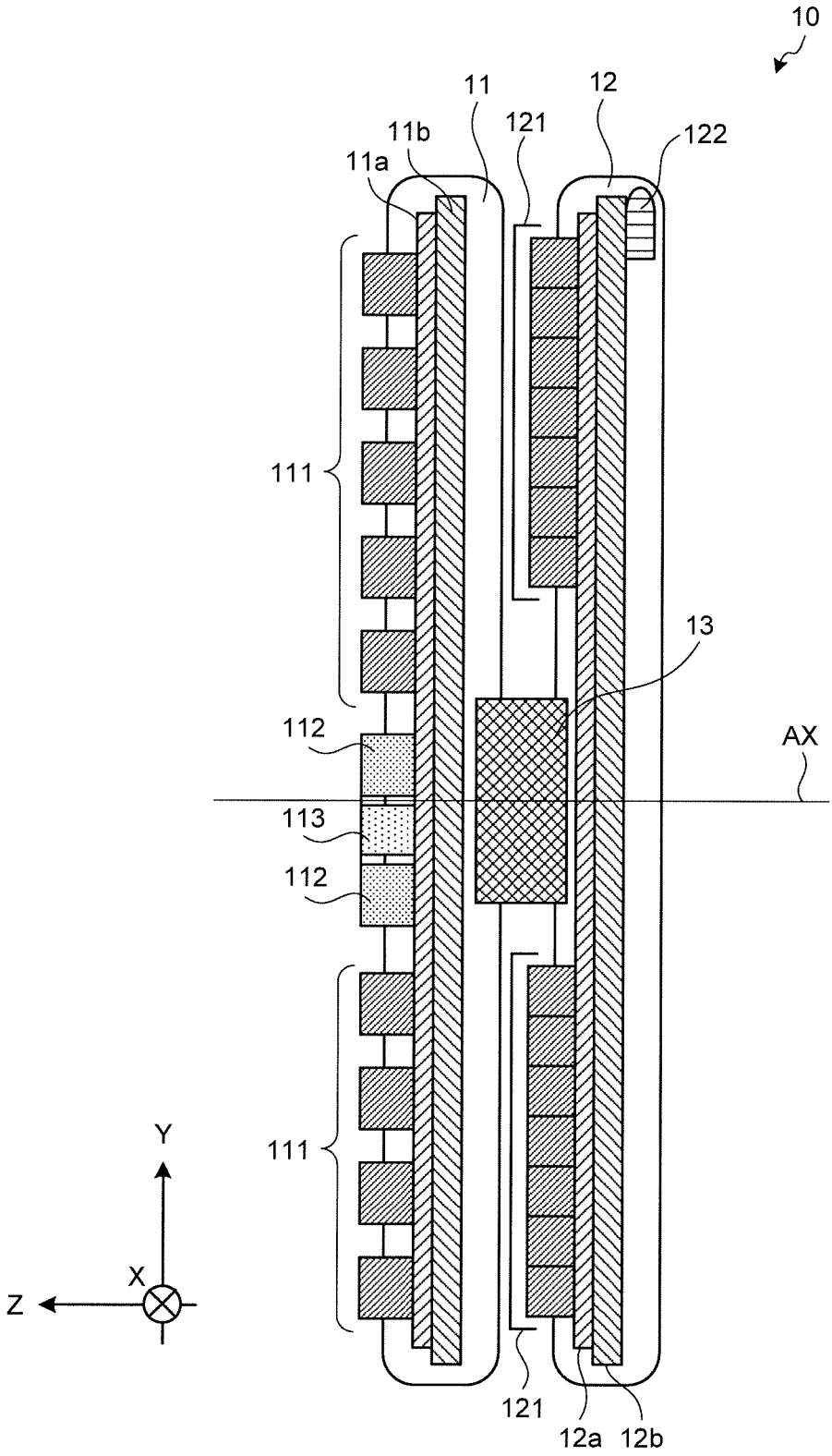
FIG. 2 is an exemplary schematic cross-sectional view of the remote controller taken along the line A-A in FIG. 1 in the embodiment.
Figure 3:
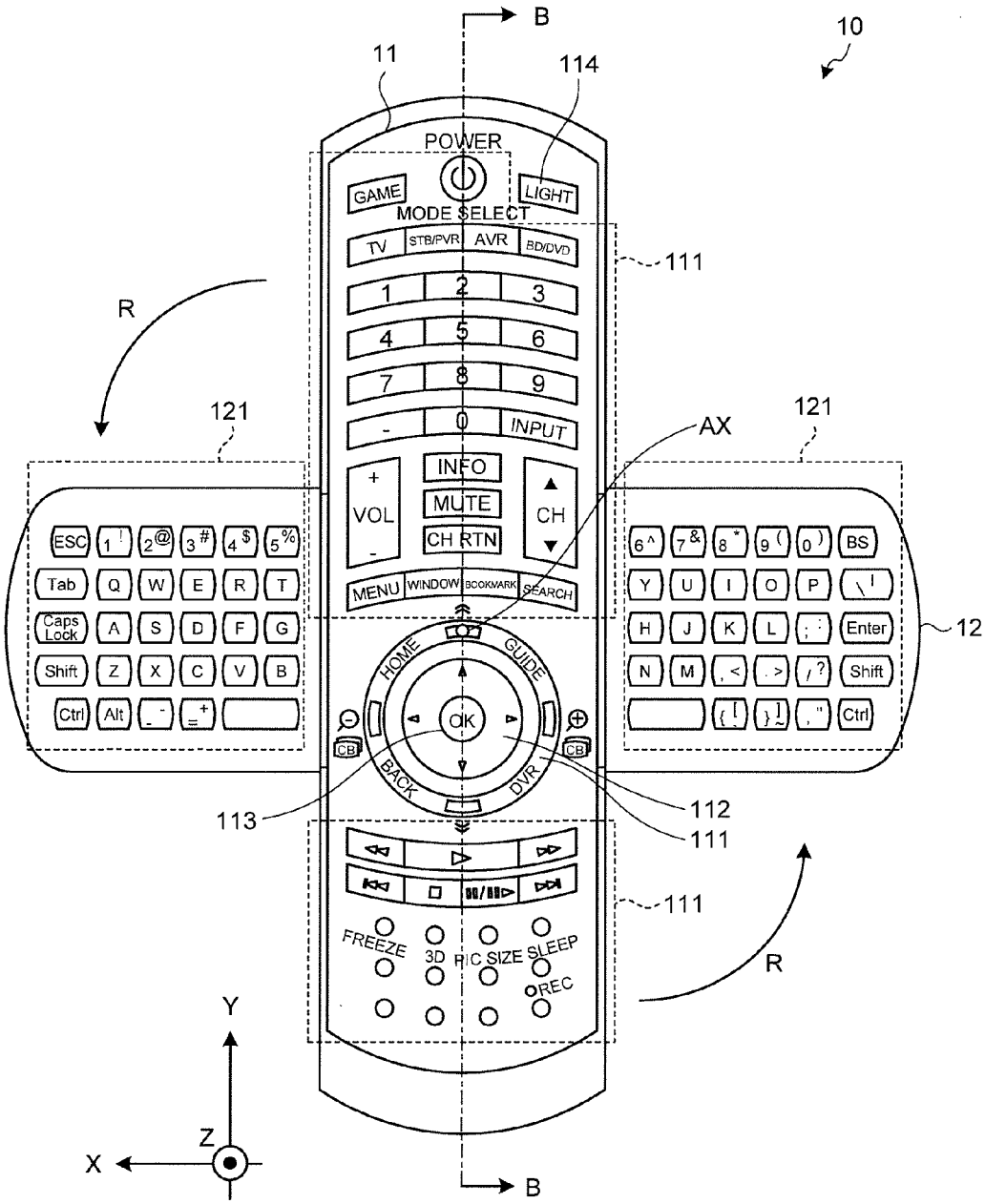
FIG. 3 is an exemplary top view of the remote controller in the open position in the embodiment.
Figure 4:
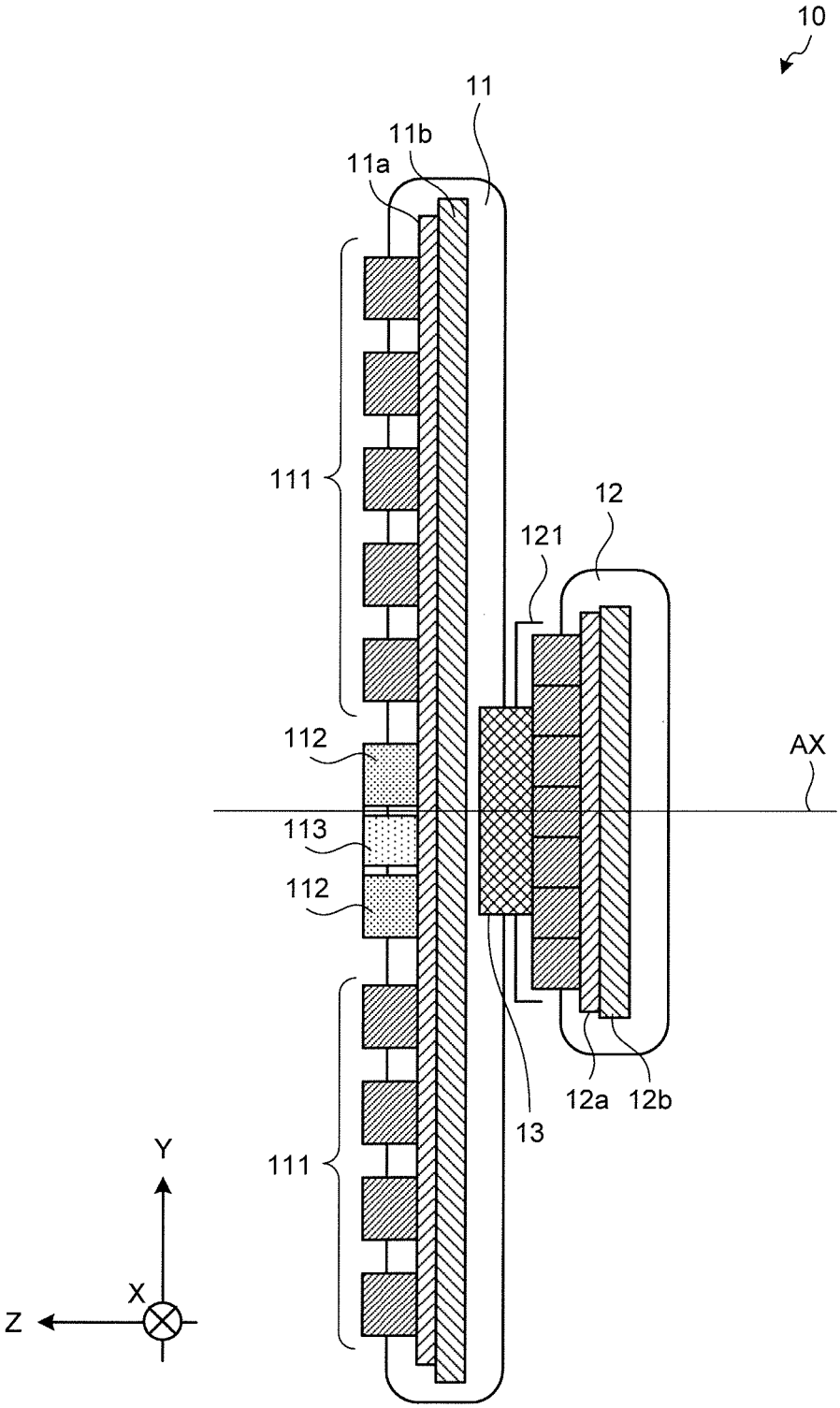
FIG. 4 is an exemplary schematic cross-sectional view of the remote controller taken along the line B-B in FIG. 3 in the embodiment.

FIGS. 1 to 4 illustrate an example of a remote controller 10 according to an embodiment. FIG. 1 is a top view of the remote controller 10 of the embodiment in the closed position. FIG. 2 is a schematic cross-sectional view of the remote controller 10 taken along the line A-A in FIG. 1. FIG. 3 is a top view of the remote controller 10 of the embodiment in the open position. FIG. 4 is a schematic cross-sectional view of the remote controller 10 taken along the line B-B in FIG. 3.

As illustrated in FIGS. 1 to 4, the remote controller 10 comprises a substantially rectangular parallelepiped upper housing 11 as the first housing, a substantially rectangular parallelepiped lower housing 12 as the second housing, and a rotational joint 13 that joins (connects) the upper housing 11 and the lower housing 12 to be relatively rotatable about a rotation axis AX. The upper housing 11 and the lower housing 12 each have substantially the same outer circumference viewed from the direction of the rotation axis AX of the rotational joint 13 (Z axis direction).

The upper surface of the upper housing 11 is an operation surface on which are arranged operation keys 111, an arrow key 112, an OK key 113, and a light key 114. The operation keys 111 are used to activate the main functions of a device to be remotely controlled (hereinafter, "operation device") and include various keys such as, for example, a channel selection key and a volume control key.

The arrow key 112 is used to move a focus (cursor) displayed on the display screen of the operation device. The OK key 113 functions as a pointing device used to move a pointer displayed on the display screen of the operation device and also is used to confirm a selection or action. The light key 114 is used to turn on a backlight (an upper backlight 115 and a lower backlight 124 in FIG. 5) of the remote controller 10, which will be described later.

As illustrated in FIGS. 2 and 4, the upper housing 11 houses a key holder 11*a* and a circuit board 11*b*. The key holder 11*a* holds the operation keys 111, the arrow key 112, the OK key 113, and the light key 114, and also the upper backlight 115 (see FIG. 5) that illuminates the keys from behind. The circuit board 11*b* is provided with a reference potential pattern (not illustrated) and the like. Any key operation performed on the upper housing 11 is output to a microprocessor 123 (see FIG. 5) of the lower housing 12 through the rotational joint 13.

The upper surface of the lower housing 12 is an operation surface which faces the bottom surface of the upper housing 11 and on which are arranged input keys 121 including an enter key. The input keys 121 are used to input letters or characters. When the user presses one of the input keys 121, a signal (key code) representing a letter, a number, etc. corresponding to the pressed key is sent to the operation device.

As illustrated in FIG. 2, on the front surface of the lower housing 12 (on the upper side in FIG. 2) is provided a transmitter 122. The transmitter 122 comprises an infrared-ray light emitting diode (LED) or Bluetooth (registered trademark) communication module and the like. The transmitter 122 is configured to transmit any operation performed by the user on the upper housing 11 or the lower housing 12 to the operation device as an event code.

As illustrated in FIGS. 2 and 4, the lower housing 12 houses a key holder 12*a*, a circuit board 12*b*, and a battery (not illustrated) as a power supply. The key holder 12*a* holds the input keys 121 arranged on the operation surface, and also the lower backlight 124 (see FIG. 5) that illuminates the keys from behind. The circuit board 12*b* is provided with a reference potential pattern (not illustrated), the microprocessor 123 (see FIG. 5), which will be described later, and the like.

The rotational joint 13 joins (connects) the upper housing 11 and the lower housing 12 to be relatively rotatable about the rotation axis AX. The rotation axis AX is located in the center, in the long and short directions, of the upper housing 11 and the lower housing 12.

As illustrated in FIGS. 2 and 3, when the remote controller 10 is in the closed position, the rotational joint 13 holds the upper housing 11 and the lower housing 12 so that their outer circumferences overlap. The rotation of the lower housing 12 in the direction indicated by arrows R in FIG. 3 allows the remote controller 10 to glide into the open position. At this time, the rotational joint 13 rotates to the position where the upper housing 11 and the lower housing 12 form substantially the right angle viewed from the direction of the rotation axis AX (Z axis direction). As a result, the input keys 121 are exposed (see FIG. 4). In this manner, when the input keys 121 are not used, the remote controller 10 can be moved into the closed position where the input keys 121 overlap the upper housing 11. Thus, the remote controller 10 can be made compact.

Figure 5:
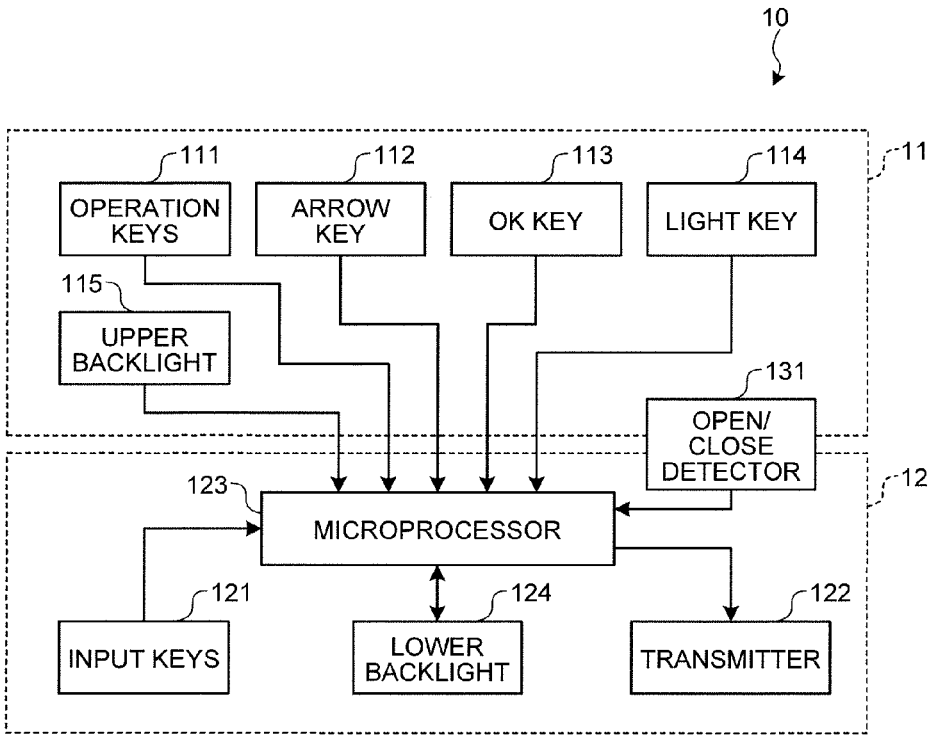
FIG. 5 is an exemplary schematic diagram of a hardware configuration of the remote controller in the embodiment.

With reference to FIG. 5, a description will be given of the hardware configuration of the remote controller 10. FIG. 5 is a schematic diagram of the hardware configuration of the remote controller 10. The remote controller 10 comprises, in addition to the operation keys 111, the arrow key 112, the OK key 113, and the light key 114, the upper backlight 115 in the upper housing 11. Besides, the remote controller 10 comprises, in addition to the input keys 121 and the transmitter 122, the microprocessor 123 and the lower backlight 124 in the lower housing 12. The remote controller 10 further comprises an open/close detector 131 that detects whether the upper housing 11 and the lower housing 12 are in the open or closed position. These elements are connected to the microprocessor 123 via a connector (not illustrated).

The open/close detector 131 detects the rotation state of the rotational joint 13, i.e., whether the remote controller 10 is in the open or closed position, and outputs the detection result to the microprocessor 123. The location of the open/close detector 131 and how to perform the detection are not particularly limited, and the detection can be performed by a known technique. For example, the open/close detector 131 may be integrally provided with the rotational joint 13 so that it can directly detect the rotation of the rotational joint 13. For another example, the open/close detector 131 may be an optical sensor provided to a portion of the lower housing 12 that is exposed in the open position.

The upper backlight 115 is arranged correspondingly to the position of the keys provided on the upper housing 11 and illuminates the keys from behind. On the other hand, the lower backlight 124 is arranged correspondingly to the position of the keys provided on the lower housing 12 and illuminates the keys from behind. The upper backlight 115 and the lower backlight 124 comprises, for example, a light-emitting diode (LED) and a light guide, and turn on/off under the control of the microprocessor 123.

The microprocessor 123 is a controller that controls the overall operation of the remote controller 10 based on various programs and various types of setting information stored in a storage medium (not illustrated) such as a read only memory (ROM). The microprocessor 123 receives a key operation performed by the user with the keys of the remote controller 10 (the operation keys 111, the arrow key 112, the OK key 113, and the input keys) and outputs a signal corresponding to the key operation to the transmitter 122.

In response to pressing the light key 114, the microprocessor 123 controls the upper backlight 115 and the lower backlight 124 individually to turn on/off according to whether the remote controller 10 is in the open/closed position detected by the open/close detector 131.

More specifically, when the remote controller 10 is in the closed position, the microprocessor 123 turns on the upper backlight 115 to illuminate the keys on the operation surface of the upper housing 11 from behind. On the other hand, when the remote controller 10 is in the open position, the microprocessor 123 turns on the upper backlight 115 and the lower backlight 124 to illuminate the keys on the operation surfaces of the upper housing 11 and the lower housing 12 from behind.

When the upper backlight 115 and/or the lower backlight 124 are/is ON, the microprocessor 123 detects whether the individual keys are not operated (hereinafter, "non-operated state") on the operation surfaces of the upper housing 11 and the lower housing 12. If the keys are in the non-operated state for a predetermined time, the microprocessor 123 turns off the upper backlight 115 and/or the lower backlight 124. It is assumed herein that the microprocessor 123 has the function of measuring elapsed time together with a time counter such as a real time clock (RTC). It is also assumed herein that the microprocessor 123 can set setting information and an arbitrary value such as some seconds with respect to the predetermined time as an index to turn off the light.

Figure 6:
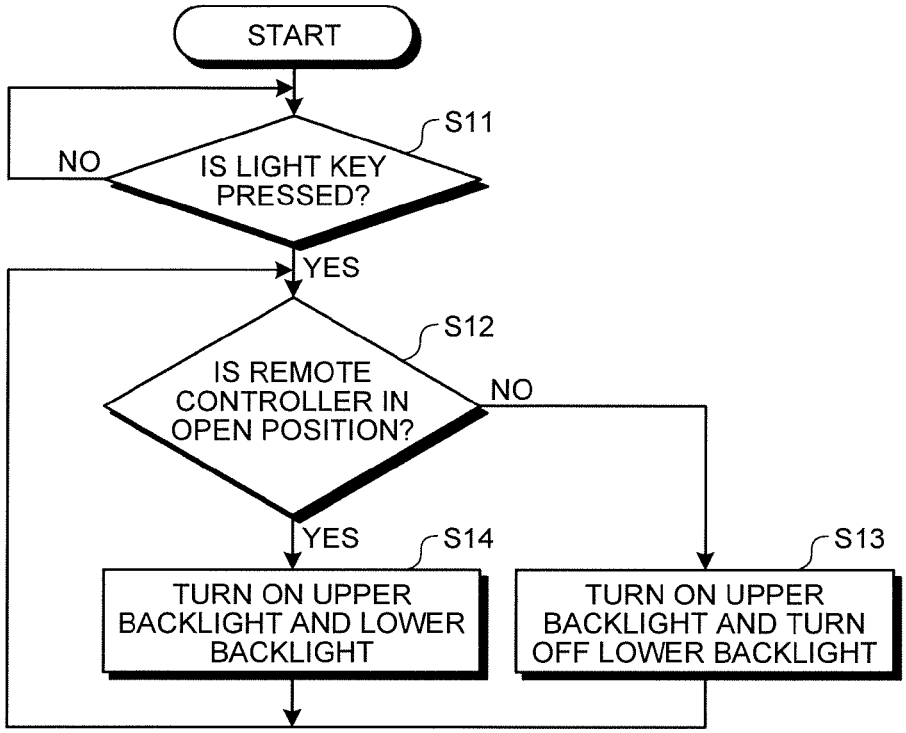
FIG. 6 is an exemplary flowchart of a first backlight control process performed by the remote controller in the embodiment.

In the following, a description will be given of the operation of the remote controller 10 to turn on/off the backlight with reference to FIG. 6. FIG. 6 is a flowchart of a first backlight control process performed by the remote controller 10 (the microprocessor 123).

First, the microprocessor 123 waits until the light key 114 is pressed (No at S11). When the light key 114 is pressed (Yes at S11), the microprocessor 123 determines whether the remote controller 10 is in the open position based on the detection result of the open/close detector 131 (S12).

Having determined that the remote controller 10 is in the closed position (No at S12), the microprocessor 123 turns on the upper backlight 115 and turns off the lower backlight 124, thereby illuminating the keys on the operation surface of the upper housing 11 from behind (S13). Then, the process returns to S12.

When the remote controller 10 is in the closed position as illustrated in FIG. 1, the operation surface of the lower housing 12 overlaps the bottom surface of the upper housing 11. This means that the user cannot use the input keys 121. Accordingly, the lower backlight 124 of the lower housing 12 is turned off and only the upper backlight 115 of the upper housing 11 is turned on to avoid unnecessary power consumption.

On the other hand, having determined that the remote controller 10 is in the open position (Yes at S12), the microprocessor 123 turns on the upper backlight 115 and the lower backlight 124, thereby illuminating the keys on the operation surfaces of the upper housing 11 and the lower housing 12 from behind (S14). Then, the process returns to S12.

When the remote controller 10 is in the open position as illustrated in FIG. 3, the operation surface of the lower housing 12 is exposed from the upper housing 11. This allows the user to use the input keys 121 on the operation surface of the lower housing 12 as well as the keys on the operation surface of the upper housing 11. Accordingly, both the upper backlight 115 of the upper housing 11 and the lower backlight 124 of the lower housing 12 are turned on to improve the operability in the dark.

Incidentally, if the remote controller 10 is moved into the open to closed position or vice versa, the lower backlight 124 is turned on/off based on the determination at S12.

Figure 7:
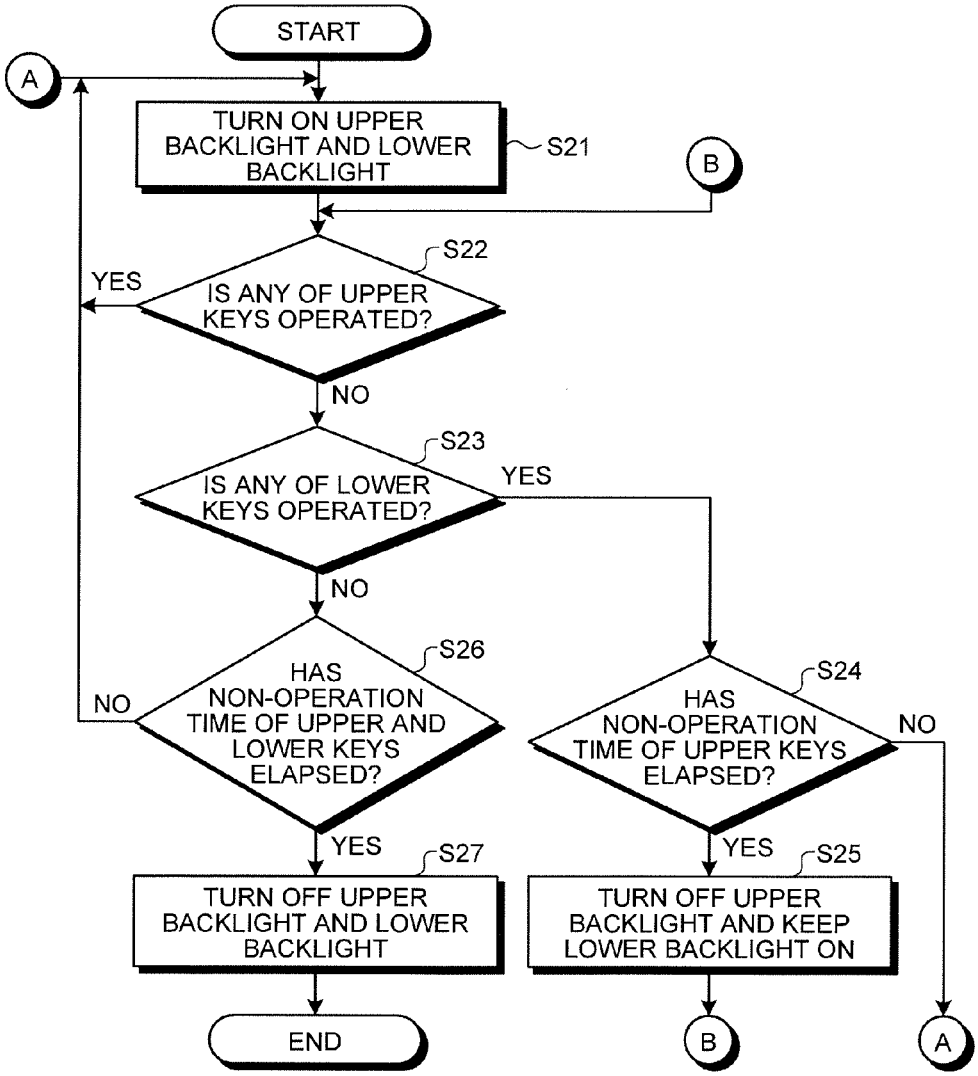
FIG. 7 is an exemplary flowchart of a second backlight control process performed by the remote controller in the embodiment.

FIG. 7 is a flowchart of a second backlight control process performed by the remote controller 10 (the microprocessor 123). The second backlight control process is performed together with the first backlight control process when the upper backlight 115 and the lower backlight 124 are turned on in first backlight control process.

In the state where both the upper backlight 115 and the lower backlight 124 are ON (S21), the microprocessor 123 determines whether any of the operation keys 111, the arrow key 112, the OK key 113, and the light key 114 (hereinafter, "upper keys") is operated (S22). If any of the upper keys is operated (Yes at S22), the process returns to S21, and the upper backlight 115 and the lower backlight 124 are kept ON.

Having determined that none of the upper keys is operated (Yes at S22), the microprocessor 123 determines whether any of the input keys 121 on the operation surface of the lower housing 12 (hereinafter, "lower keys") is operated (S23). Having determined that any of the lower keys is operated (Yes at S23), the microprocessor 123 determines whether a predetermined time (hereinafter, "non-operation time") has elapsed since the detection of non-operated state of the upper keys (S24). If the non-operation time has not yet elapsed (No at S24), the process returns to S21.

On the other hand, having determined that the non-operation time has elapsed (Yes at S24), the microprocessor 123 turns off the upper backlight 115 and keeps the lower backlight 124 ON, thereby illuminating only the input keys 121 on the operation surface of the lower housing 12 from behind (S25). Then, the process returns to S22.

Having determined that none of the lower keys is operated (No at S23), the microprocessor 123 determines whether the non-operation time has elapsed with respect to the upper and lower keys (S26). If the non-operation time has not yet elapsed (No at S26), the process returns to S21.

On the other hand, having determined that the non-operation time has elapsed (Yes at S26), the microprocessor 123 turns off the upper backlight 115 and the lower backlight 124 (S27). Then, the process ends.

With the process described above, upon turning off the backlight since the keys have not been operated for a predetermined time, the upper backlight 115 and the lower backlight 124 are controlled base on the operation state of the upper and lower keys. Accordingly, only the upper backlight 115 or both the upper backlight 115 and the lower backlight 124 are turned off. Thus, when the remote controller 10 is in the open position, the lower backlight 124 of the lower housing 12 is preferentially turned on. If the upper keys have not been operated for a predetermined time, only the upper backlight 115 is turned off. This reduces unnecessary power consumption and improves convenience in operating the lower keys.

Incidentally, in the case where only the upper backlight 115 is ON (in the state at S13 of FIG. 6), if the upper keys have not been operated for the predetermined time, the upper backlight 115 is also turned off.

The key arrangement of the remote controller 10 is not limited as described in the above embodiment (see FIGS. 1 and 3), and an arbitrary operation key may be arranged. Besides, while the backlight is described above as being turned on when the light key 114 is pressed, it is not so limited. For example, the backlight may be turned on when a key other than the light key 114 is pressed. The backlight may also be turned on by the movement of the remote controller 10 into the open/closed position as a trigger. Further, the backlight may be turned off if the light key 114 is pressed while the backlight is ON.

While, in the above embodiment, the upper backlight 115 and the lower backlight 124 are provided as illumination modules (first and second illumination modules) to illuminate the upper and lower keys, it is not so limited. For example, a light may be provided to illuminate each of the upper and lower keys in a position where it can illuminate each of the keys. The location of the light is not particularly limited, and may be located around or near the upper and lower keys. In the case of the remote controller 10 illustrated in FIG. 3, for example, if a pair of lights are provided near the center of both long sides of the upper housing 11, the lower keys can be illuminated when the remote controller 10 is in the open position.

While, in the above embodiment, the upper housing 11 and the lower housing 12 are joined so that they are relatively rotatable about the rotation axis AX located in substantially the center of the upper housing 11 and the lower housing 12, it is not so limited. The rotation axis AX may be located in any other part.

While, in the above embodiment, as illustrated in FIGS. 1 to 4, the remote controller 10 is described as being moved into the open/closed position by rotating the upper housing 11 and the lower housing 12 on the rotational joint 13, it is not so limited. For example, the remote controller 10 may be provided with, instead of the rotational joint 13, a slide mechanism that allows one of the upper housing 11 and the lower housing 12 to slide in the long direction (Y axis direction in FIG. 1) or the short direction (X axis direction in FIG. 1) of the upper housing 11 with respect to the other.

Figure 8:
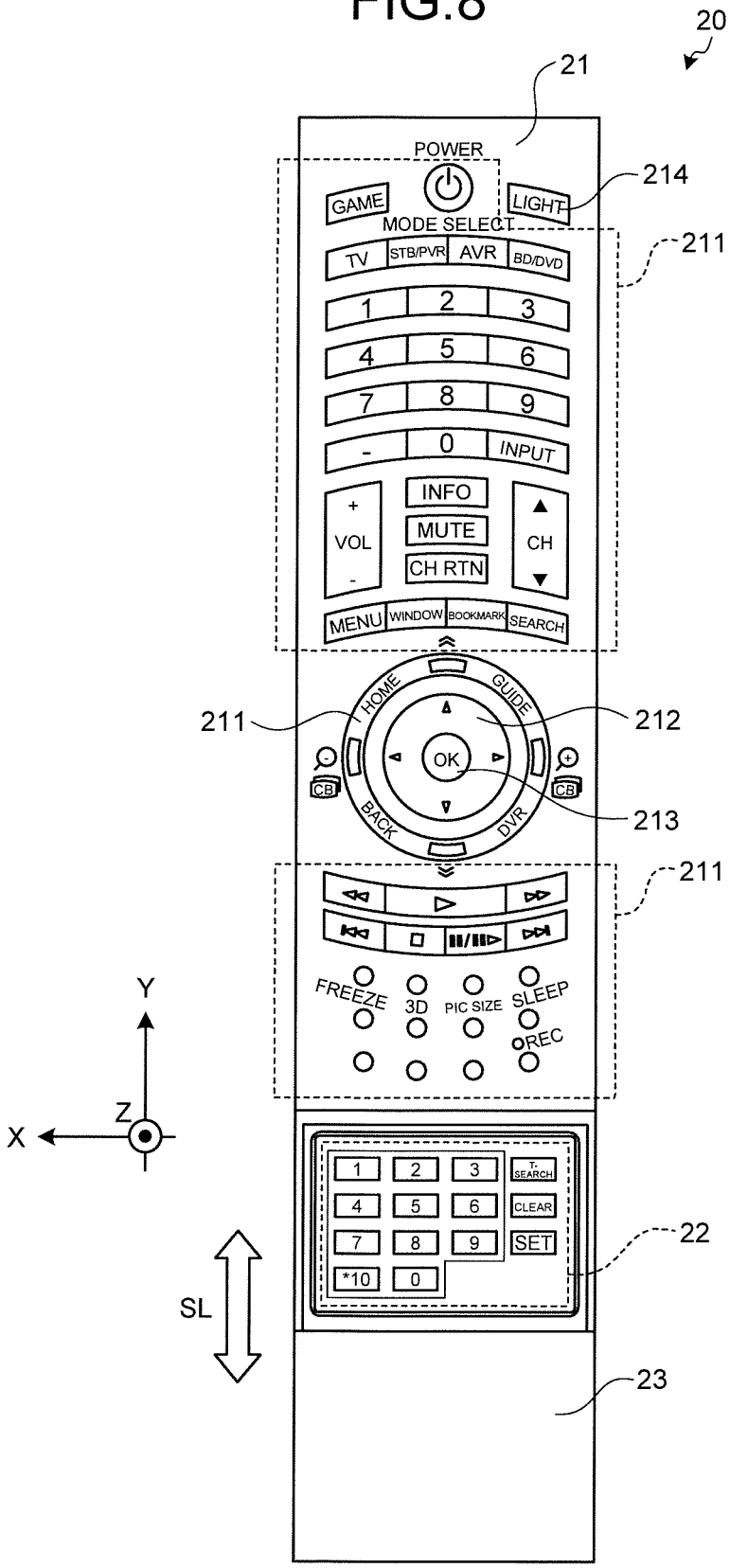
FIG. 8 is an exemplary top view of a remote controller according to a modification of the embodiment.

FIG. 8 is a top view of a remote controller 20 according to a modification of the embodiment. As illustrated in FIG. 8, the remote controller may comprise a single housing as with the remote controller 20. Referring to FIG. 8, the remote controller 20 comprises a main body 21, and is provided with operation keys 211, an arrow key 212, an OK key 213, and a light key 214 on the operation surface of the main body 21. The operation keys 211, the arrow key 212, the OK key 213, and the light key 214 correspond to the operation keys 111, the arrow key 112, the OK key 113, and the light key 114, respectively.

Operation keys 22 are related to number input and the like. The operation keys 22 are usually covered with a cover 23 that is slidable in the directions indicated by arrow SL so that they are not exposed on the operation surface of the main body 21. When input is provided through the operation keys 22, the cover 23 is slid to expose the operation keys 22. Although not illustrated, the main body 21 comprises a main backlight that illuminates the operation keys 211, the arrow key 212, the OK key 213, and the light key 214 from behind, a sub-backlight that illuminates the operation keys 22 from behind, and an open/close detector that detects whether the cover 23 is open or closed.

In the case of the remote controller 20, the main backlight and the sub-backlight are turned on/off according to whether the cover 23 is open or closed based on the first backlight control process and the second backlight control process. Thus, the same effect as described previously can be achieved.

The various modules of the systems described herein can be implemented as software applications, hardware and/or software modules, or components on one or more computers, such as servers. While the various modules are illustrated separately, they may share some or all of the same underlying logic or code.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A remote controller comprising:

first operation keys;

a first illumination module configured to illuminate the first operation keys;

second operation keys arranged in different location than the first operation keys;

a second illumination module configured to illuminate the second operation keys;

a non-operated state detector configured to detect whether the first operation keys and the second operation keys are not operated, individually;

a controller configured to control turning on or off the first illumination module and the second illumination module in accordance with a detection result of the non-operated state detector, wherein, while the first illumination module and the second illumination module are on, if the first operation keys are not operated for a predetermined time and the second operation keys are not operated for less than the predetermined time, the controller turns off the first illumination module and the second illumination module remains on.

2. The remote controller of claim 1, further comprising an open-close detector configured to detect open and closed position of a first housing including the first operation keys and the first illumination module and a second housing including the second operation keys and the second illumination module, wherein the controller is configured to control turning on and off of the first illumination module and the second illumination module in accordance with a detection result of the open-close detector.

3. The remote controller of claim 2, wherein the controller is configured to turn on the first illumination module when the first housing and the second housing are in the close position, and turn on the first illumination module and the second illumination module when the first housing and the second housing are in the open position.

4. The remote controller of claim 1, wherein the controller is configured to turn off the first illumination module and the second illumination module if the first operation keys and the second operation keys are not operated for the predetermined time.

5. The remote controller of claim 2, wherein the first operation keys comprises at least a light key configured to provide an instruction to turn illumination on, and the open-close detector is configured to detect the open and close positions of the first and second housings in accordance with an operation of the light key.

6. The remote controller of claim 1, wherein a first housing comprising the first operation keys on an upper surface thereof and the first illumination module at a location where the first illumination module can illuminate the first operation keys;

a second housing comprising the second operation keys on an upper surface thereof and the second illumination module at a location where the second illumination module can illuminate the second operation keys; and an open-close mechanism configured to rotatably connect the first housing and the second housing relative to each other while placing the first housing on an upper surface of the second housing so as to realize an open position and a closed position, the upper surface of the second housing being covered with a bottom surface of the first housing in the closed position, the second operation keys being exposed from the bottom surface of the first housing in the open position.

7. The remote controller of claim 6, wherein the open-close mechanism is configured to rotate the first housing and the second housing relative to each other about a rotation axis at a substantially center of the first housing and the second housing and substantially perpendicular to operation surfaces of the first housing and the second housing.

8. The remote controller of claim 6, wherein the first and the second housings are in a substantially rectangular shape.

9. The remote controller of claim 1, wherein, while the first illumination module and the second illumination module are turned on, if the first operation keys are not operated for the predetermined time and the second operation keys are not operated for less than the predetermined time, the controller turns off the first illumination module and the second illumination module remains turned on.

10. A remote controller control method applied to a remote controller comprising first operation keys, a first illumination module configured to illuminate the first operation keys, second operation keys arranged in different location than the first operation keys, a second illumination module configured to illuminate the second operation keys, and a cover capable of covering the second operation keys, the remote controller control method comprising:

detecting, by a non-operated state detector, whether the first operation keys and the second operation keys are not operated individually; and controlling, by a controller, on and off of the first illumination module and the second illumination module in accordance with a detection result of the non-operated state detector, wherein while the first illumination module and the second illumination module are on, if the first operation keys are not operated for a predetermined time and the second operation keys are not operated for less than the predetermined time, the controller turns off the first illumination module and the second illumination module remains on.

11. A remote controller comprising:

a first plurality of operation keys;

a first backlight configured to illuminate the first plurality of operation keys;

a second plurality of operation keys arranged in a different location from the first plurality of operation keys;

a second backlight configured to illuminate the second plurality of operation keys;

a state detector configured to monitor operating states of the first plurality of operation keys and the second plurality of operation keys;

a controller configured to control activation of the first illumination module and the second illumination module based on the monitored operating states, wherein, while the first backlight and the second backlight are turned on, if the first plurality of operation keys are in an non-operating state for a predetermined time and the second plurality of operation keys are in an non-operating state for an amount of time less than the predetermined time, the controller turns off the first backlight and the second backlight remains on.

12. The remote controller of claim 11, further comprising a first housing comprising an upper surface including the first plurality of operation keys and the first backlight being positioned under the upper surface to illuminate the first plurality of operation keys;

a second housing comprising an upper surface including the second plurality of operation keys and the second backlight being positioned under the upper surface to illuminate the second plurality of operation keys;

an open-close detector configured to detect open and closed positions of the first housing and the second housing, wherein the controller is configured to control activation of the first backlight and the second backlight based on the detected positions of the first housing and the second housing by the open-close detector.

13. The remote controller of claim 12, wherein the controller is configured to activate the first backlight when both the first housing and the second housing are in the closed position, and activate both the first backlight and the second backlight when both the first housing and the second housing are in the open position.

14. The remote controller of claim 11, wherein the controller is configured to deactivate the first backlight and the second backlight if the first operation keys and the second operation keys are not placed in the operating state for the predetermined time.

15. The remote controller of claim 12, wherein the first plurality of operation keys comprises at least a light key configured to provide an instruction to activate the first backlight, and the open-close detector is configured to detect the open and closed positions of the first housing and second housings in accordance with an operation of the light key.

16. The remote controller of claim 11 further comprising:

a first housing comprising an upper surface including the first plurality of operation keys and the first backlight being positioned under the upper surface to illuminate the first plurality of operation keys;

a second housing comprising an upper surface including the second plurality of operation keys and the second backlight being positioned under the upper surface to illuminate the second plurality of operation keys; and an open-close mechanism to rotatably couple the first housing and the second housing relative to each other while placing the first housing on an upper surface of the second housing so as to realize an open position and a closed position, the upper surface of the second housing being covered with a bottom surface of the first housing in the closed position, the second plurality of operation keys being exposed from the bottom surface of the first housing in the open position.

17. The remote controller of claim 16, wherein the open-close mechanism is configured to rotate the first housing and the second housing relative to each other about a rotation axis at a substantially center of the first housing and the second housing and substantially perpendicular to upper surfaces of the first housing and the second housing.

* * * * *